US007001218B2

(12) United States Patent
Kato et al.

(10) Patent No.: US 7,001,218 B2
(45) Date of Patent: Feb. 21, 2006

(54) CONNECTOR AND CONNECTOR GROOVE

(75) Inventors: Masato Kato, Kanagawa (JP); Hiroshi Fukuzaki, Kanagawa (JP); Tsuyoshi Fukami, Kanagawa (JP); Yoichi Kasamaru, Kanagawa (JP); Masaharu Takai, Kanagawa (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 11/000,078

(22) Filed: Dec. 1, 2004

(65) Prior Publication Data

US 2005/0142921 A1 Jun. 30, 2005

(30) Foreign Application Priority Data

Dec. 1, 2003 (JP) ..... 2003-402296

(51) Int. Cl.
*H01R 24/00* (2006.01)

(52) U.S. Cl. ..... 439/630; 439/733.1

(58) Field of Classification Search ..... 439/630, 439/733.1; 425/577, DIG. 58; 264/318
See application file for complete search history.

(56) References Cited

U.S. PATENT DOCUMENTS 5,320,552 A * 6/1994 Reichardt et al. ..... 439/331
5,897,889 A * 4/1999 Shao ..... 425/577
6,409,529 B1 * 6/2002 Liu et al. ..... 439/188
6,607,405 B1 * 8/2003 Nishimura ..... 439/630
6,699,053 B1 * 3/2004 Kuroda ..... 439/218
6,835,100 B1 * 12/2004 Chen ..... 439/630

FOREIGN PATENT DOCUMENTS

JP 2001-135387 A 5/2001
JP 2001-313107 A 11/2001
JP 2001-313128 A 11/2001
JP 2002-134234 A 5/2002

* cited by examiner

*Primary Examiner*—Gary F. Paumen
(74) *Attorney, Agent, or Firm*—Rader, Fishman & Grauer PLLC

(57) ABSTRACT

A connector, which enables the molding of narrow press-fitting grooves for cantilever contacts and has cantilever contact press-fitting grooves of a structure such that the molding dies for the grooves will have adequate strength and durability, is provided.

In molding a rectangular first press-fitting groove 421, in which a first fixed part 5B of a cantilever contact 5 is press-fitted, a plurality of upper-face opened recess parts 42U, which are continuous with the first press-fitting groove 421, are molded by an upper die 1. Lower-face opened recess parts 42D, which are continuous with the first press-fitting groove 421, are molded by a lower die 2. By the combination of the upper die 1 and the lower die 2, the upper-face opened recess parts 42U and the lower-face opened recess parts 42D are formed in an alternating manner. The first press-fitting groove 421 is formed in an intermittent manner by the upper-face opened recess parts 42U and the lower-face opened recess parts 42D.

5 Claims, 8 Drawing Sheets

51
5A
5B
5
5C
52
A
B
C 51
5A 5C
515
516

5B
511
512
513
514

431
43

10
52
62
6B
6A
61
424
5
6
421
5B
5A
51
420
42

52
5C
422
423
4

CONNECTOR AND CONNECTOR GROOVE

CROSS-REFERENCE TO RELATED APPLICATIONS

This application is based upon and claims the benefits of priorities from Japanese Patent Application No. 2003-402296 filed on Dec. 1, 2003, the entire contents of which are incorporated herein by reference.

This application is related to co-pending U.S. patent applications entitled "Connector" and "Memory Card Connector," and being filed on even date herewith. The co-pending applications are expressly incorporated herein by reference.

FIELD OF THE INVENTION

The present invention relates to a connector. In particular, the present invention relates to a connector comprising a housing, in which contact cavities (or grooves) are formed, and cantilever contacts, which are press-fitted in the contact cavities (or grooves).

RELATED ART

As an example of a connector equipped with cantilever contacts, for example, there is a memory card connector such that a memory card having surface contact terminals arranged at an end part is electrically connected to cantilever contacts upon insertion of the memory card into the memory card connector. Among memory cards, there are storage memory cards and information management memory cards.

As examples of storage memory cards, there exist the SD (Secure Digital) card, Memory Stick card, Smart Media, MMC (Multimedia Card), etc. Also, as examples of information management memory cards, there is the SIM (Subscriber Identify Module) card, which is used as an IC card that is mounted to a portable telephone.

Composite type memory card connectors, which enable simultaneous mounting of a plurality of types of such memory cards that differ in shape and in the alignment of surface contact terminals, are being demanded. Common-use memory card connectors, enabling the mounting of any of a plurality of types of memory cards, are also being demanded.

As an abovementioned composite type connector, a memory card connector, which holds surface contact terminals of an MMC and an SIM card inside a connector housing in a manner such that the surface contact terminals contact cantilever contacts, positioned inside the connector housing, and has a first card housing part, having cantilever contacts for MMC positioned therein and housing an MMC, and a second card housing part, having cantilever contacts for SIM card positioned therein and housing an SIM card, positioned in the vertical direction, has been invented (for example, Japanese Published Unexamined Patent Publication No. 2002-134234).

With the memory card connector of Japanese Published Unexamined Patent Publication No. 2002-134234, the connector housing is arranged so that the respective directions in which the cantilever contacts for MMC and the cantilever contacts for SIM card are positioned are substantially perpendicular to each other. Furthermore, the first card housing part, which houses an MMC, which is larger in outer shape than an SIM card, is positioned at the lower side of the connector housing, and the second housing part, which houses an SIM card, is positioned at the upper side of the connector housing. The memory card connector of Japanese Published Unexamined Patent Publication No. 2002-134234 enables reducing the stature of the connector housing.

FIG. 9 shows a memory card connector according to an embodiment of the invention described in Japanese Published Unexamined Patent Publication No. 2002-134234 and is a perspective view showing the state in which an opening/closing cover is opened. FIG. 9 of the present Application corresponds to FIG. 1 in Japanese Published Unexamined Patent Publication No. 2002-134234.

In FIG. 9, a first card housing part 91 for housing an MMC is formed at a lower stage of a connector housing 90. Meanwhile, a second card housing part 92 for housing an SIM card is formed at an upper stage of connector housing 90.

In FIG. 9, an MMC is inserted into the first card housing part 91 from the direction of the arrow A in the figure, and in regard to unillustrated cantilever contacts for MMC, solder-bonded parts 93A of the cantilever contacts for MMC extend outward from the side opposite the side of an insertion port of the first card housing part 91.

Meanwhile in FIG. 9, an SIM card is installed in the second card housing part 92. On the bottom face of the second card housing part 92, cantilever contacts 94, of the two types of long and short, are positioned so that the contact points oppose each other. The SIM card cantilever contacts 94 have solder-bonded parts 94A extending out in mutually opposite directions from the connector housing 90.

In FIG. 9, when an opening/closing cover 95 is closed and covers the second card housing part 92, an SIM card is connected with the plurality of cantilever contacts 94. The opening/closing cover 95 is enabled to be locked to the connector housing 90.

In FIG. 9, a plurality of press-fitting grooves 9, for the positioning and press-fitting of the plurality (six in the present case) of SIM card cantilever contacts 94, are formed in the bottom face of the second card housing part 92.

In order to perform molding (plastic molding) of each of the plurality of press-fitting grooves 9, respectively, having a rectangular cross section and having opposing pairs of flanges at parts of the upper surface, a metal core (or so-called core), having a cross-section of the same shape as the part for fixing the cantilever contact 94, and an upper die, serving as the main die, are necessary.

However, when the plurality of press-fitting grooves 9 shown in FIG. 9 become narrower, it becomes difficult to mold the grooves using metal cores and an upper die. Especially in regard to drawing out the metal cores that serve as cores after molding, it becomes more difficult to ensure the strength of the metal cores for withstanding the drawing-out process as the press-fitting grooves 9 become even narrower.

For example, the cantilever contacts arranged in a memory card connector are becoming narrower in width in accompaniment with the narrowing of the pitch of alignment of the contacts. Furthermore, with a common-use memory card connector, the cantilever contacts that contact one of the types of memory card are narrow at their fixed parts. A new structure for press-fitting grooves in which such narrow fixed parts are press-fitted is being demanded.

SUMMARY OF THE INVENTION

The present invention has been made to solve the above issues and an object thereof is to provide a connector, with which narrow press-fitting grooves for cantilever contacts can be molded and which has cantilever contact press-fitting grooves of a structure such that the molding dies for the grooves will have adequate strength and durability.

In order to achieve the above object, the present inventor invented a connector having a structure, with which narrow press-fitting grooves for cantilever contact can be molded using an upper die and a lower die and which has press-fitting grooves of a new structure as described below.

(1) A connector comprising:

an insulating housing, in which contact cavities are formed; and at least one cantilever contact, to be press-fitted into at least one of the contact cavities;

wherein each of the contact cavities comprising a rectangular press-fitting groove, in which a fixed part of the cantilever contact is press-fitted, has upper-face opened recess parts and lower-face opened recess parts in an alternating manner such that a continuous groove space defined by the press-fitting groove comprises an upper-face open space defined by each of the upper-face opened recess parts and an lower-face open space defined by each of the lower-face opened recess parts, in an alternating manner.

(2) A memory card connector, which is electrically connected to a memory card by inserting the memory card having surface contact terminals arranged at an end part, the memory card connector comprising:

a housing comprising a card holding part of an approximately thin rectangular parallelepiped shape including a housing space and a card insertion port, through which the memory card is inserted, the memory card being held in the housing space so that the surface contact terminals are located at a near position from the card insertion port; and a plurality of cantilever contacts having contact points being positioned in the card holding part, the contact points to be contacted with the surface contact terminals of the memory card, each of the cantilever contacts having a lead part, to be solder-bonded to an opposite side to the contact points, extending outside from a stopping wall opposite to the card insertion port;

wherein a plurality of first press-fitting grooves for holding first fixed parts near free ends part having the contact points, are formed in a bottom surface of the card holding part, wherein a plurality of second press-fitting grooves for holding second fixed parts near the lead parts, are formed in a bottom face of the housing that opposes to the bottom face of the card holding part, each of the first press-fitting grooves has upper-face opened recess parts and lower-face opened recess parts, which are continuous with the first press-fitting groove, formed therein in an alternating manner, and each of the first press-fitting groove is formed in an intermittent manner by the upper-face opened recess parts and lower-face opened recess parts.

In an aspect according to (1), there is provided a connector comprising: an insulating housing, in which contact cavities are formed; and one or more cantilever contacts, press-fitted into the abovementioned contact cavities; wherein each of the abovementioned contact cavities, which are rectangular press-fitting grooves in which fixed parts of the abovementioned cantilever contacts are press-fitted, has upper-face opened recess parts and lower-face opened recess parts, which are continuous with the press-fitting grooves, formed in alternating manner, and each of the abovementioned contact cavities is formed in an intermittent manner by the abovementioned upper-face opened recess parts and lower-face opened recess parts.

A contact cavity may be a hole provided in the insulating housing for insertion of a contact, and a contact cavity in which a cantilever contact is inserted is normally formed as a rectangular through hole or a rectangular groove. A cantilever contact may be press-fitted in this rectangular through hole or rectangular groove.

A cantilever contact is a contact, with which the function of a spring is provided by a cantilever type plate spring, and comprises a free end part, having a contact point that contacts a contacted body, and a fixed part, which is supported by the housing. In the case of a connector that is surface mounted to a printed circuit board, the extending end part of the fixed part may be a lead that is solder-bonded to the printed circuit board.

The fixed part of a cantilever contact may have micro-protrusions formed in mutually opposing manner in the width direction, and when this fixed part is press-fitted into the insulating housing, the abovementioned pairs of micro-protrusions become wedged between the inner walls of the rectangular-shaped press-fitting grooves and the fixed part thereby becomes fixed to the housing.

In the case where the fixed part of a cantilever contact is narrow, the rectangular press-fitting groove, into which the fixed part is press-fitted, may be formed to have a "dovetail groove"-like form. More substantially, the rectangular press-fitting groove that is formed to have a "dovetail groove"-like form may be a groove having a bottleneck-like cross-section.

In forming this rectangular press-fitting groove, the upper-face opened recess parts that are continuous with the press-fitting groove are molded using an upper die, and the lower-face opened recess parts that are continuous with the press-fitting groove are molded using a lower die. The upper die and lower die are combined so that the upper-face opened recess parts and the lower-face opened recess parts will be formed in an alternating manner, and by the upper-face opened recess parts and the lower-face opened recess parts, the press-fitting groove is formed in an intermittent manner.

The distinction between "upper face" and "lower face" or "upper" and "lower" is relative and these do not define an absolute positional relationship. One face of the housing wall in which a press-fitting groove is formed is referred to as the "upper face" and the other face opposite the abovementioned one face is referred to as the "lower face." The upper die is used to mold the upper-face opened recess parts and the lower die is used to mold the lower-face opened recess parts.

Thus with the present invention, since a narrow press-fitting groove for a cantilever contact is molded by a combination of an upper die and a lower die that make up a pair, the molding of a narrow press-fitting groove is enabled without the use of a metal core, with which there are apprehensions in regard to the strength, as in the prior art.

Also, since each of the upper-face opened recess parts and the lower-face opened recess parts is made shallow in the depth of the recess, the upper die and the lower die for molding the upper-face opened recess parts and the lower-face opened recess parts are dies of adequate strength and durability.

In another aspect according to the present invention, there is provided a memory card connector, which, by the insertion of a memory card, having surface contact terminals aligned at an end part, becomes electrically connected to the memory card, the memory card connector comprising: a housing, having a card holding part having the shape of an approximately thin rectangular parallelepiped, arranged as a housing space with a card insertion port into which the abovementioned memory card is inserted, formed therein and in which the abovementioned memory card is held so that the abovementioned surface contact terminals stop at a position close to the abovementioned card insertion port; and a plurality of cantilever contacts, having contact points, contacting the surface contact terminals of the abovementioned memory card, and with which the abovementioned contact points are positioned in the abovementioned card holding part and lead parts, solder-bonded at the side opposite the contact points, extend outward from a stopping wall that opposes the abovementioned card insertion port: wherein a plurality of first press-fitting grooves, for holding first fixed parts near free ends part having the abovementioned contact points, are formed in a bottom face of the abovementioned card holding part, a plurality of second press-fitting grooves, for holding second fixed parts near the abovementioned lead parts, are formed in a bottom face of the housing that opposes the abovementioned bottom face of the card holding part, each of the abovementioned first press-fitting grooves has upper-face opened recess parts and lower-face opened recess parts, which are continuous with the first press-fitting groove, formed therein in an alternating manner, and each of the abovementioned first press-fitting groove is formed in an intermittent manner by the abovementioned upper-face opened recess parts and lower-face opened recess parts.

Thus with the present invention, since a narrow press-fitting groove for a cantilever contact is molded by a combination of an upper die and a lower die that make up a pair, the molding of a narrow press-fitting groove is enabled without the use of a metal core, with which there are apprehensions in regard to the strength, as in the prior art.

Furthermore, since each of the upper-face opened recess parts and the lower-face opened recess parts, which are formed in a narrow press-fitting groove for cantilever contact, is made shallow in the depth of the recess, the upper die and the lower die for molding the upper-face opened recess parts and the lower-face opened recess parts are dies of adequate strength and durability.

Further features of the invention, its nature, and various advantages will be more apparent from the accompanying drawings and the following detailed description of the invention.

DESCRIPTION OF THE PREFERRED EMBODIMENT

The preferred embodiment of the present invention will be described below in reference to the drawings. However, the present invention is not limited to the embodiment, and various modifications and changes in design can be made without departing from the scope of the present invention.

Figure 1:
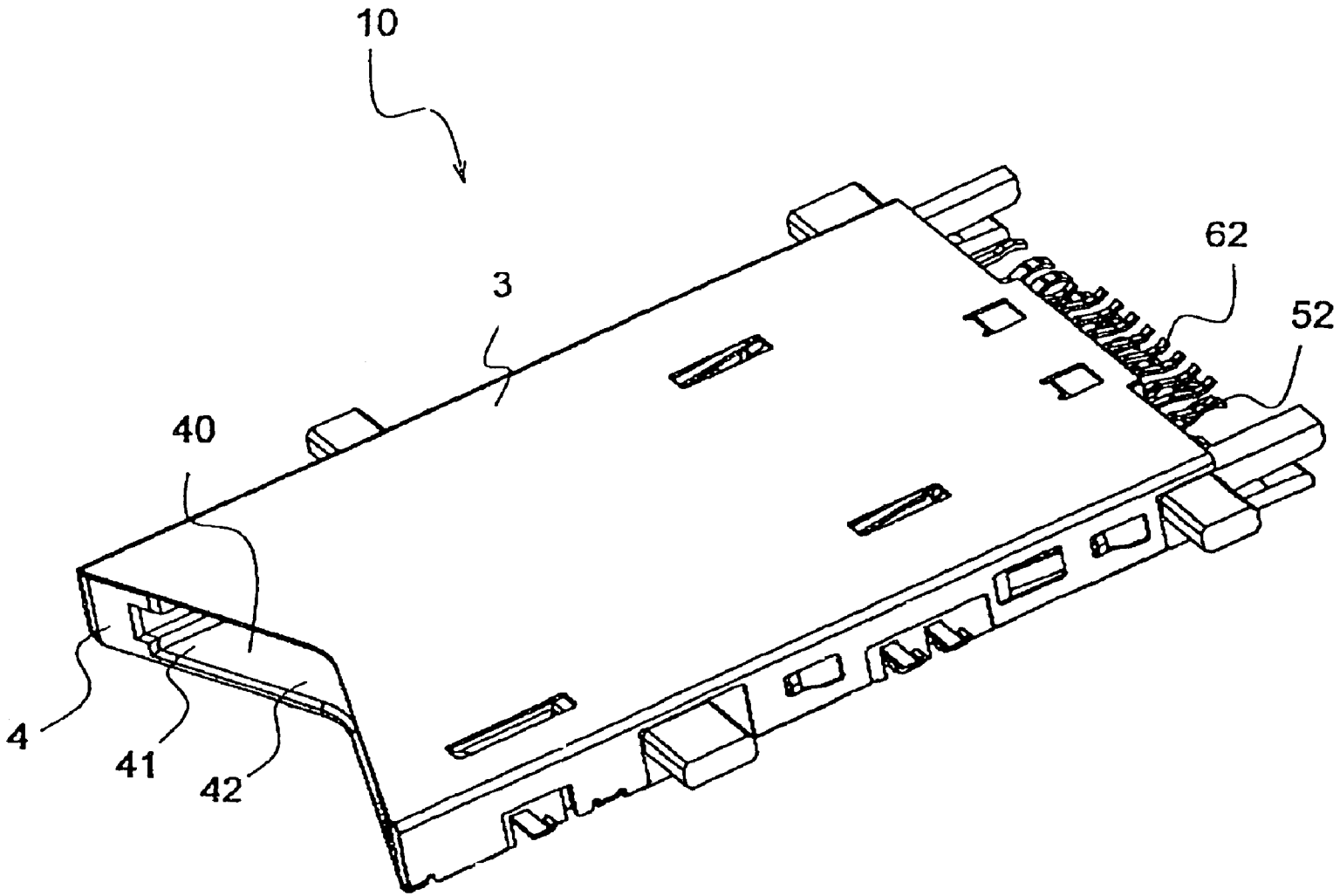
FIG. 1 is an external perspective view showing a connector according to an embodiment of the present invention.

FIG. 1 is an external perspective view showing a connector according to an embodiment of the present invention. The connector 10 shown in FIG. 1 is a memory card connector that is used in common for an SD card and a Memory Stick card. This memory card connector shall hereinafter be described according to an embodiment of the present invention.

In FIG. 1, according to an embodiment, a cover 3 is formed of a thin metal plate with which both flanks are bent to a right angle. A housing 4 is molded to an approximately thin rectangular parallelepiped shape from an insulating resin material. The housing 4 has an upper-face opened recess part 40 formed therein.

In FIG. 1, according to the embodiment, the cover 3 covers the upper-face opened recess part 40 such that a card holding part 42 of an approximately thin rectangular parallelepiped shape so as to form a housing space with a card insertion port 41, through which an SD card or a Memory Stick card may be inserted in common, is formed.

In FIG. 1, according to the embodiment, a plurality of cantilever contacts 5, which shall be described later and which contact surface contact terminals of an SD card, are aligned inside the housing 4 on the opposite side to the card insertion port 41. The plurality of cantilever contacts 5 extend outside from the side surface opposite to the card insertion port 41 and each is equipped with a first lead part 52 that is solder-bonded to an unillustrated printed circuit board.

With the embodiment of FIG. 1, a plurality of cantilever contacts 6, which shall be described later and which contact surface contact terminals of a Memory Stick card, are aligned inside the housing 4 at the side opposite the card insertion port 41. The plurality of cantilever contacts 6 extend out from the side face opposite the card insertion port 41 and each is equipped with a second lead part 62 that is solder-bonded to an unillustrated printed circuit board.

With the embodiment of FIG. 1, each of the plurality of first lead parts 52 and the plurality of second lead parts 62 is bent and curved at a front end part to enable easy insertion into a printed circuit board. The respective curved parts are positioned in opposing manner with a fixed interval in between so as to contact the respective faces of the printed circuit board.

Figure 2:
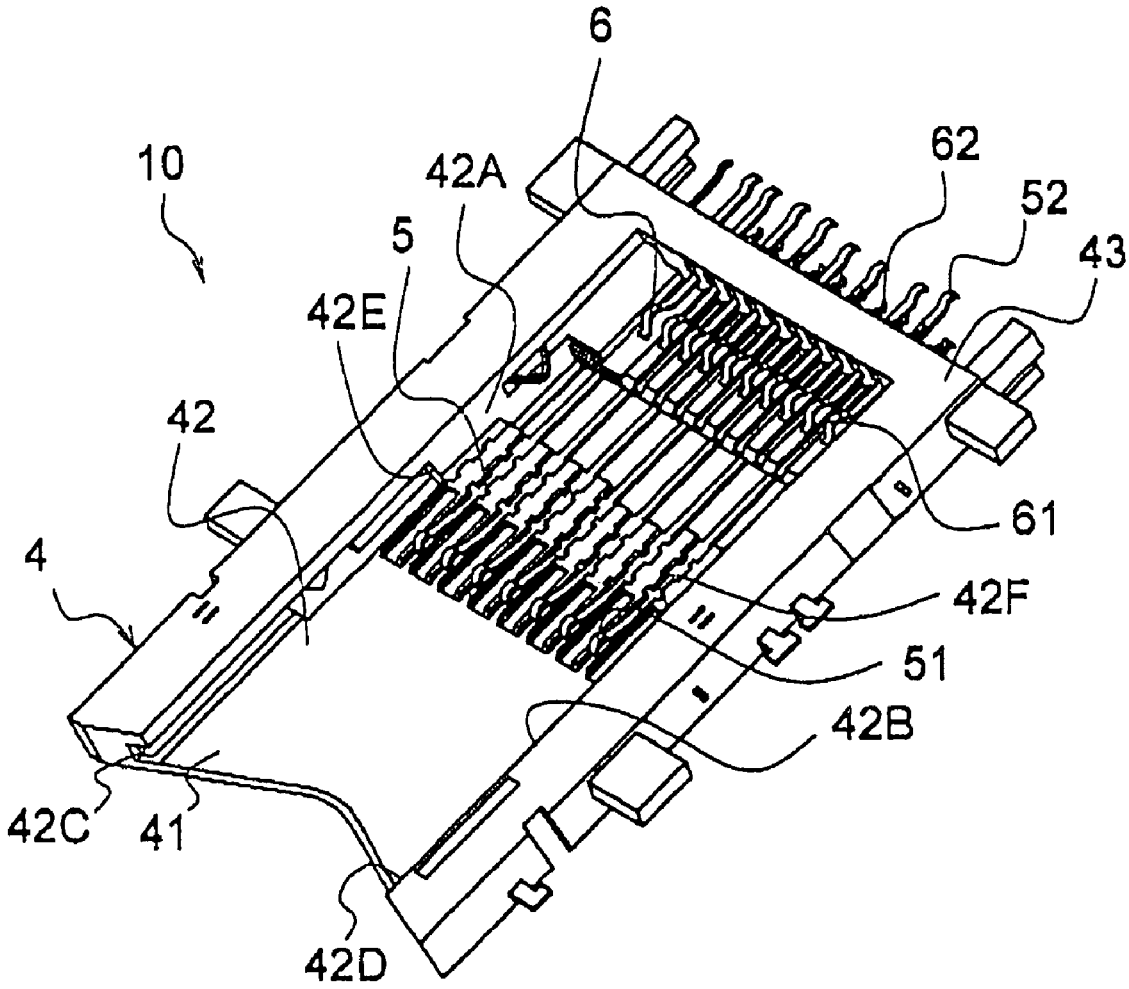
FIG. 2 is an external perspective view of the connector shown in FIG. 1 in the state in which a cover is removed according to the embodiment of the present invention.

FIG. 2 is an external perspective view of the connector 10 shown in FIG. 1 in the state in which the cover 3 is removed. As shown by the embodiment in FIG. 1, a pair of grooves 42C and 42D, along which the opposing side faces of an SD card that is inserted from the card insertion port 41 are guided, are formed in the opposing pair of inner walls 42A and 42B of card holding part 42.

The interval between the mutually opposing grooves 42C and 42D is slightly wider than the horizontal width of an SD card. An SD card is restricted in the horizontal width direction by these grooves 42C and 42D to enable positioning of the surface contact terminals of the SD card with respect to the plurality of cantilever contacts 5.

Also, stopping ends 42E and 42F are provided at the pair of grooves 42C and 42D, respectively, so that the surface contact terminals of an SD card will stop at a position close to the card insertion port 41.

As shown in FIG. 2, each cantilever contact 5 is a plate spring contact. The cantilever type contact is made to function by the action of the plate spring. The plurality of cantilever contacts 5 are aligned and positioned along a direction perpendicular to the direction of insertion of an SD card.

Meanwhile, as shown by the embodiment of FIG. 2, the opposing side faces of a Memory Stick card that is inserted from the card insertion port 41 are guided by the opposing pair of inner walls 42A and 42B of the card holding part 42.

The interval between the mutually opposing inner walls 42A and 42B is slightly wider than the horizontal width of a Memory Stick card. A Memory Stick card is restricted in the horizontal width direction by these inner walls 42A and 42B to enable positioning of the surface contact terminals of the Memory Stick card with respect to the plurality of cantilever contacts 6.

Also, by the contacting of a Memory Stick card with a stopping wall 43 opposite the card insertion port 41, the surface contact terminals of the Memory Stick card is made to stop at a position far from the card insertion port 41.

As shown in FIG. 2, each cantilever contact 6 is a plate spring contact. The cantilever type contact is made to function by the action of the plate spring. The plurality of cantilever contacts 6 are aligned and positioned along the width direction of a Memory Stick card, which is a direction perpendicular to the direction of insertion of the Memory Stick card.

With the embodiment of FIG. 2, the plurality of cantilever contacts 5 have first contact points 51 that contact the surface contact terminals of an SD card. With the plurality of cantilever contacts 5, the first contact points 51 are positioned in card holding part 42. The first lead parts 52, which are solder-bonded at the sides opposite the first contact points 51, extend out from the stopping wall 43 opposite the card insertion port 41.

Also, with the embodiment of FIG. 2, the plurality of cantilever contacts 6 have second contact points 61 that contact the surface contact terminals of a Memory Stick card. With the plurality of cantilever contacts 6, the second contact points 61 are positioned in the card holding part 42. The second lead parts 62, which are solder-bonded at the sides opposite the second contact points 61, extend out from the stopping wall 43 opposite the card insertion port 41.

And with the embodiment of FIG. 2, the plurality of cantilever contacts 5 and the plurality of cantilever contacts 5 are aligned in housing 4 so as to be parallel. Also, the plurality of first lead parts 52 and the plurality of second lead parts 62 extend out from stopping wall 43 so as to be parallel. Furthermore, the plurality of first lead parts 52 and the plurality of second lead parts 62 are positioned so as to oppose each other across a fixed interval.

Figures 3A, 3B, 3C, 3D, 3E:
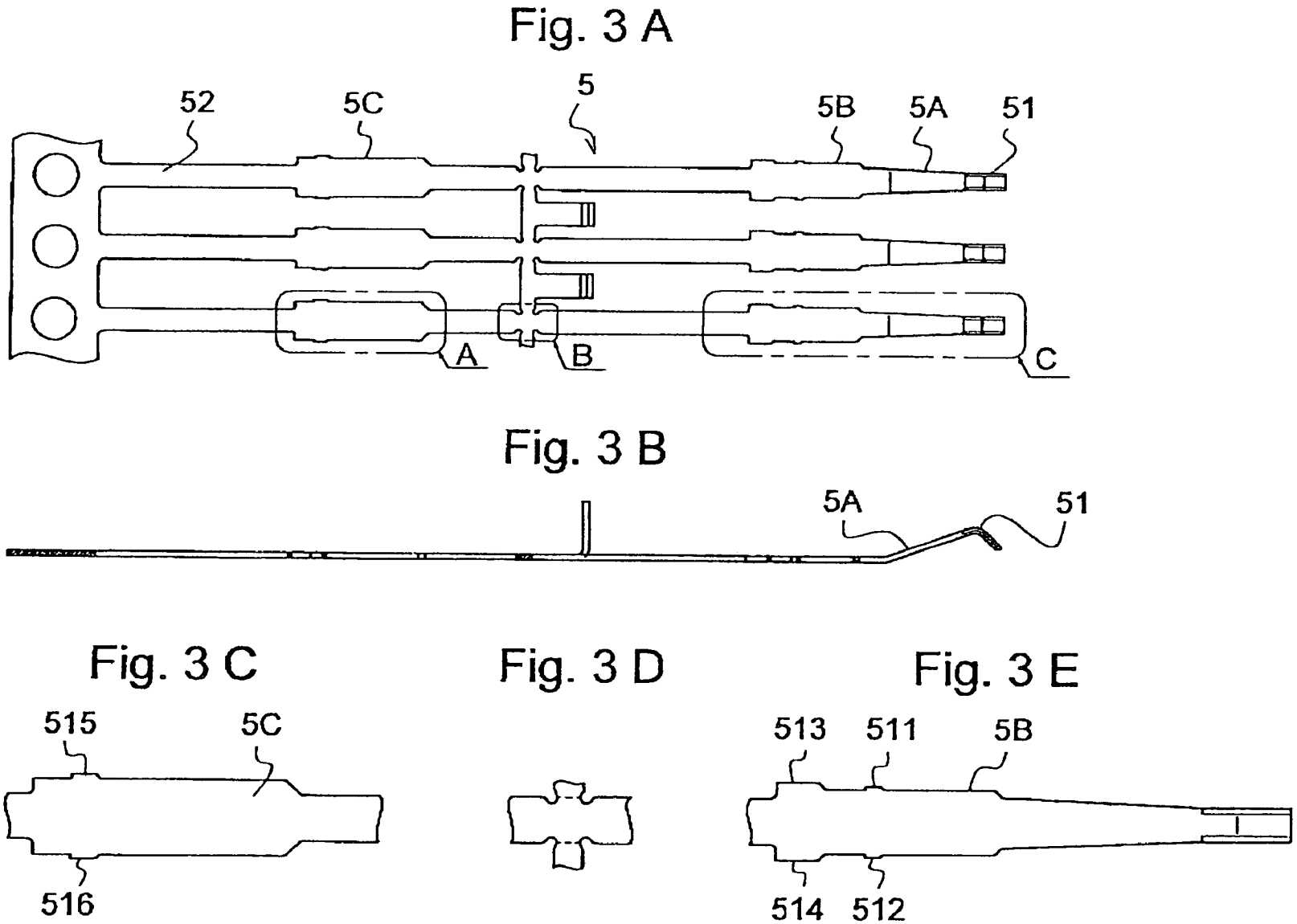
FIGS. 3A–E are arrangement diagrams of the cantilever contacts shown in FIG. 2.

The arrangement of the cantilever contacts 5 shown in FIG. 2 shall now be described by way of FIGS. 3A to 3E. FIG. 3A is a plan view of cantilever contacts 5 and FIG. 3B is a front view of a cantilever contact 5. Also, FIG. 3C is an enlarged view of the A portion shown in FIG. 3A, FIG. 3D is an enlarged view of the B portion shown in FIG. 3A, and FIG. 3E is an enlarged view of the C portion shown in FIG. 3A.

As shown by the embodiment of FIG. 3, a plurality of cantilever contacts 5 are formed in a batch by precision punching of a thin metal plate. Though the plurality of cantilever contacts 5 are connected at intermediate parts and terminal parts, these connecting parts are cut off in the assembly process. That is, these parts are cut off, for example, by the bending of the dotted line parts shown in FIG. 30.

With the embodiment of FIG. 3, each cantilever contact 5 has a first fixed part 5B formed near a first free end part 5A, which is provided with a first contact point 51. Also, each cantilever contact 5 has a second fixed part 5C formed near the first lead part 52.

The first fixed part 5B is press-fitted in a first press-fitting groove 421 formed on a bottom face 420 of the card holding part 42 to be described later. Meanwhile, the second fixed part 5C is press fitted in a second press-fitting groove 422, formed on a bottom face 423 of the housing 4 that opposes the bottom face 420 of the card holding part 42 to be described later.

Also, as illustrated most clearly in FIG. 3E, the first fixed part 5B has first microprotrusions 511 and 512 formed in a mutually opposing manner so as to form a pair in the width direction. The first fixed part 5B also has second microprotrusions 513 and 514 formed in a mutually opposing manner so as to form a pair in the width direction.

Meanwhile, as illustrated most clearly in FIG. 3C, the second fixed part 5C has third microprotrusions 515 and 516 formed in a mutually opposing manner so as to form a pair in the width direction. By the first microprotrusions 511 and 512 and the third microprotrusions 515 and 516 becoming wedged between the inner walls of the rectangular first press-fitting groove 421 and second press-fitting groove 422, respectively, the first fixed part 5B and the second fixed part 5C become fixed to the housing 4 (see FIG. 2).

Figures 4A, 4B, 4C, 4D, 4E:
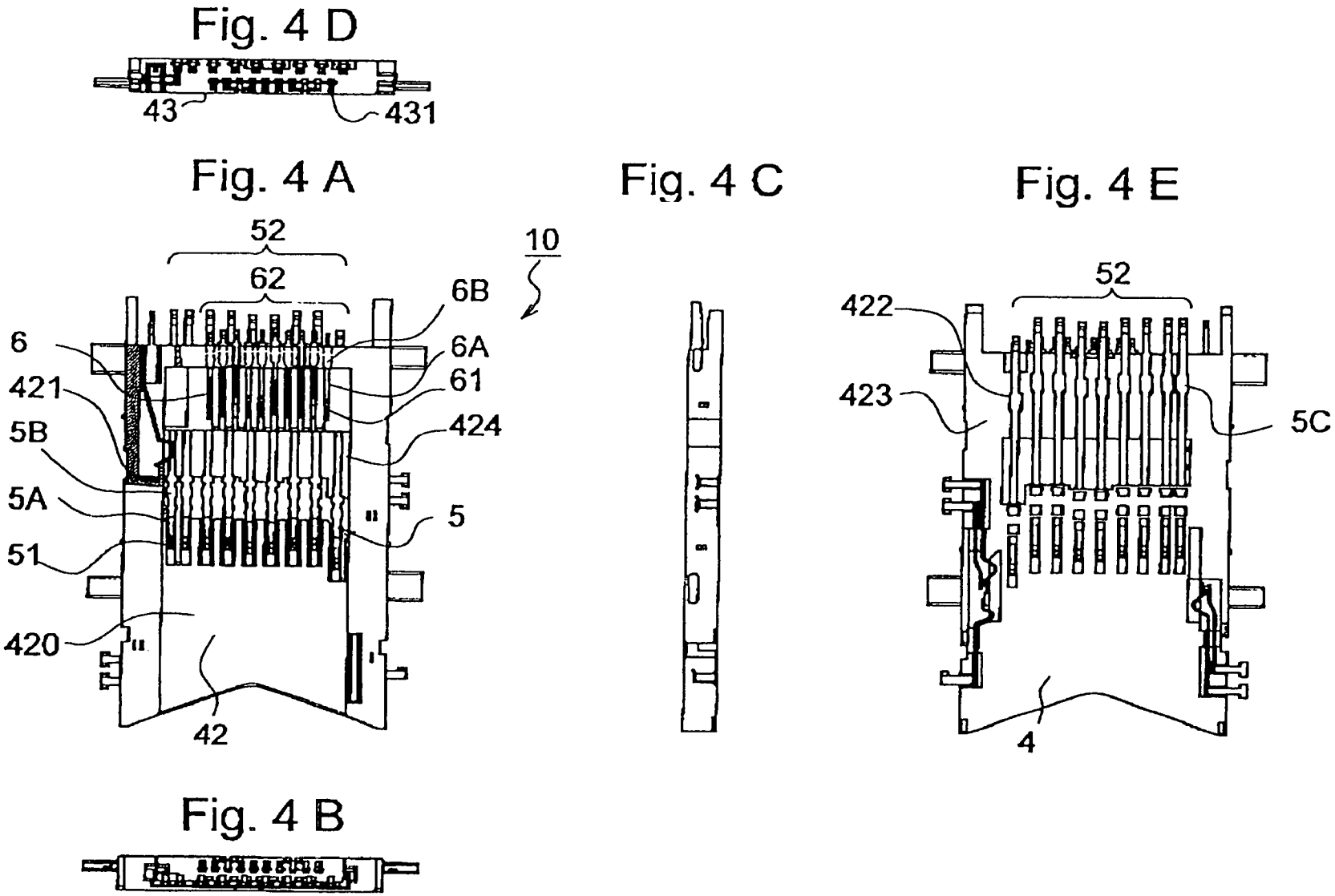
FIGS. 4A–E are arrangement diagrams of the connector shown in FIG. 2 in the state in which the cover is removed according to the embodiment of the present invention.

The arrangement of the connector 10 shall now be described further by way of FIGS. 4A to 4E. FIG. 4A is a plan view, partly in section, of the connector 10 shown in FIG. 2 in the state in which the cover 3 has been removed. FIG. 4B is a front view of FIG. 4A and FIG. 4C is a right side view of FIG. 4A. FIG. 4D is a rear view of FIG. 4A and FIG. 4E is a bottom view of FIG. 4A.

As is illustrated most clearly in FIG. 4A, the plurality of first press-fitting grooves 421, for holding the first fixed parts 5B near the first free end parts 5A having the first contact points 5A, are formed on the bottom face 420 of the card holding part 42.

Also, as is illustrated most clearly in FIG. 4E, the plurality of second press-fitting grooves 422, for holding the second fixed parts 5C near the first lead parts 52, are formed on the bottom face 423 of the housing 4 that opposes the bottom face 420 of the card holding part 42.

With the embodiment shown in FIG. 4, through holes 424, by which the plurality of first press-fitting grooves 421 and the plurality of second press-fitting grooves 422 are isolated from each other, are formed in the bottom surface 420 of the card holding part 42. With each cantilever contact 5, the first free end part 5A is inserted in a through hole 424 and the first fixed part 5B and the first fixed part 5C are press-fitted coactingly in the first press-fitting groove 421 and the second press-fitting groove 422.

Meanwhile with the embodiment shown in FIG. 4, a plurality of rectangular holes 431, for holding the third fixed parts 6B that are continuous with the second free end parts 6A having the second contact points 61, are formed in the stopping wall 43. The plurality of rectangular holes 431 are formed through towards the card insertion port 41, and with each cantilever contact 6, the second free end part 6A is inserted towards the card insertion port 41 in a rectangular hole 431 and the third fixed part 8B is press-fitted in the rectangular hole 431.

The operation of the connector according to the present invention shall now be described.

Figure 5:
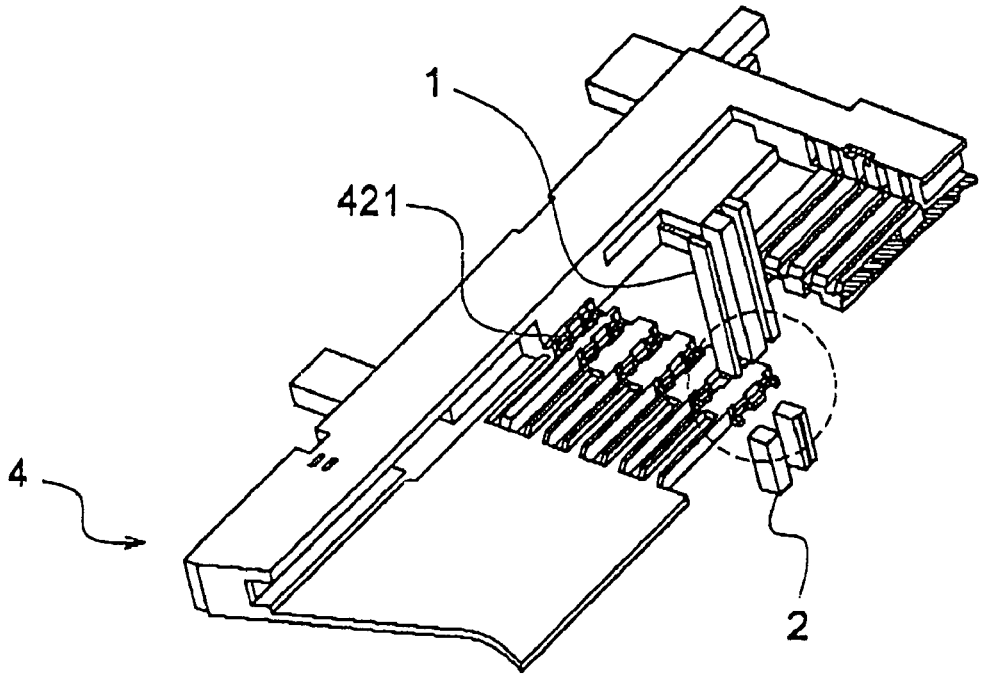
FIG. 5 is an enlarged partial perspective view with a longitudinal section of a housing according to the embodiment of the present invention.

FIG. 5 is an external perspective view of a longitudinal section of the housing 4. With the embodiment of FIG. 5, an upper die 1 and a lower die 2 are positioned for molding a first press-fitting groove 421, in which a first fixed part 5B in a cantilever contact 5 shown in FIG. 3 is press-fitted.

FIG. 6 is an enlarged view of the portion of FIG. 5 that is surrounded by a dotted-line circle. With the embodiment of FIG. 6, in molding a rectangular, first press-fitting groove 421, a plurality of upper-face opened recess parts 42U, which are continuous with the first press-fitting groove 421, are molded by the upper die 1. Meanwhile, a plurality of lower-face opened recess parts 42D, which are continuous with the first press-fitting groove 421, are molded by the lower die 2.

Figure 6A:
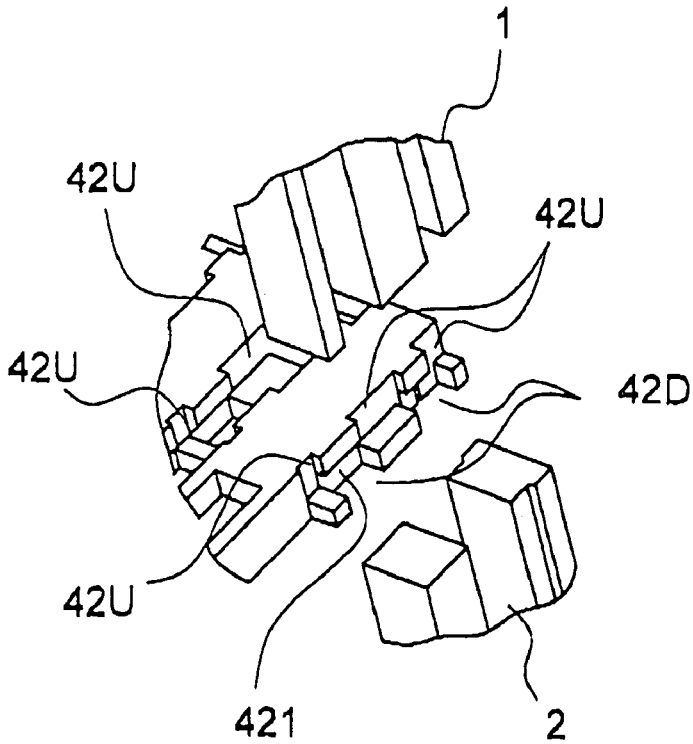
FIG. 6A is an enlarged view of the portion surrounded by the dotted-line circle in FIG. 5.

As shown by the embodiment of FIG. 6A, by the combination of the upper die 1 and the lower die 2, the upper-face opened recess parts 42U and the lower-face opened recess parts 42D are formed in an alternating manner. A first press-fitting groove 421 is thus formed in an intermittent manner by the upper-face opened recess parts 42U and the lower-face opened recess parts 42D.

Figure 6B:
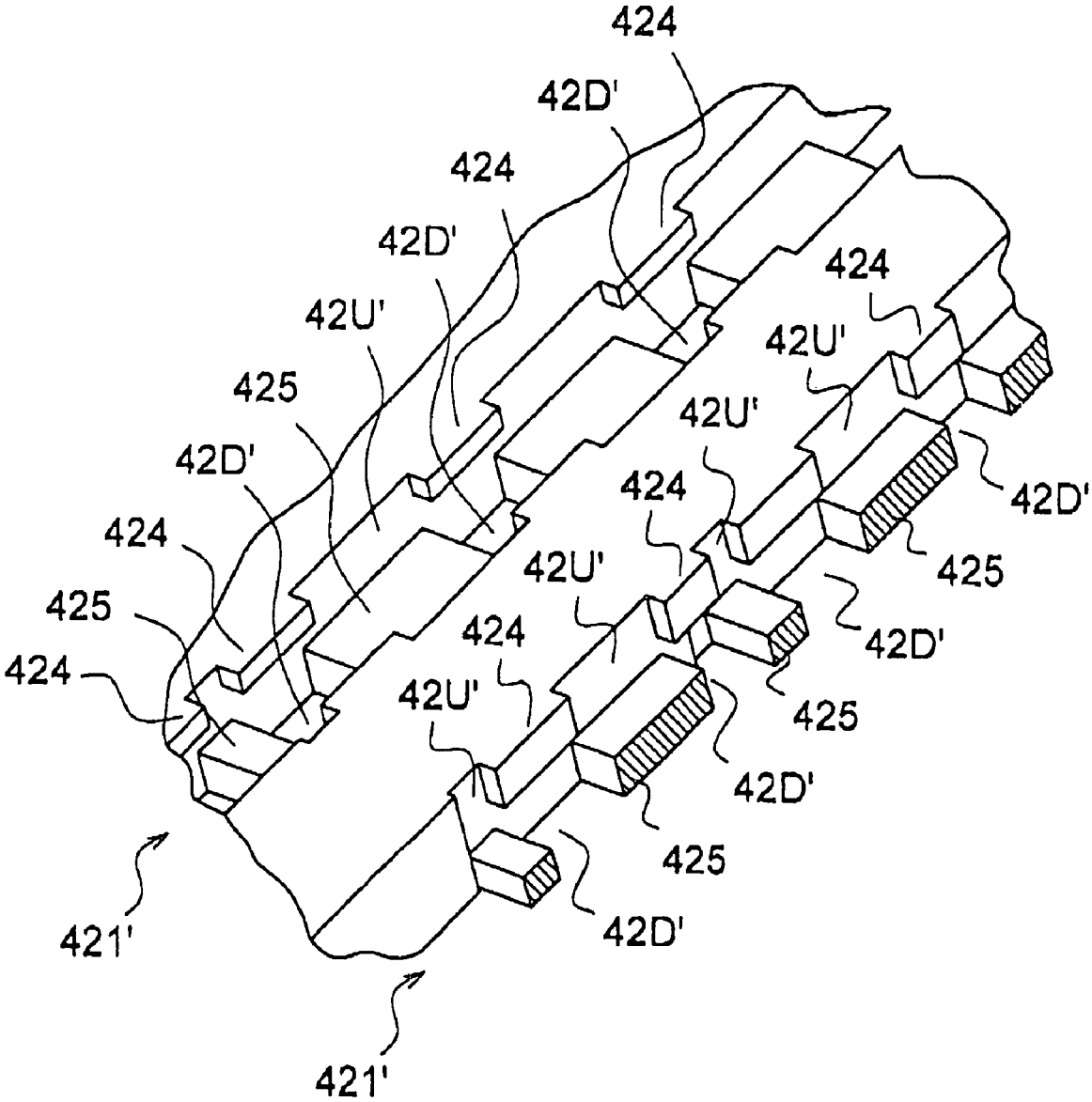
FIG. 6B shows another example similar to that in FIG. 6A.

FIG. 6B shows another embodiment of a first press-fitting groove 421'. The groove 421' is surrounded by lateral side walls and bottom wall 425 and partial top wall 424. The bottom wall 425 extends along a longitudinal direction of the groove 421' in a discontinuous manner such that lower-face opened recess parts 42D' follow the bottom walls 425 alternatively. The partial top wall 424 may be described as a projection protruding laterally from an upper part of the lateral side wall. It may be difficult to mold the partial top wall 424 unless there is an opening of the lower-face opened recess part 42D' since a core penetrating the groove 421' may be needed to mold such a projection 424 with the upper die.

Figure 7:
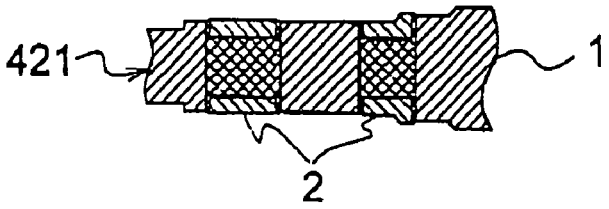
FIG. 7 is a diagram showing opposing upper and lower dies in the state in which the respective opposing faces are superposed according to the embodiment of the present invention.

FIG. 7 is a diagram showing the opposing upper die 1 and lower die 2 in the state in which the respective opposing faces are superposed. In FIG. 7, the portions with the hatching running from the upper right side to lower left side indicate the opposing surface of the upper die 1, and the portions with the hatching running from the upper left side to lower right side indicate the opposing surface of the lower die 2. The portions at which the hatchings overlap are drawn in twill-like form.

As shown in FIG. 7, by the precise combination of the upper die 1 and the lower die 2, a first press-fitting groove 421 that matches the cross-sectional shape of first fixed part 5B, shown in FIG. 38, is formed. In FIG. 7, step parts are provided in the first press-fitting groove 421, and the second microprotrusions 513 and 514, shown in FIG. 3, are positioned and stopped by these step parts.

Figure 8A:
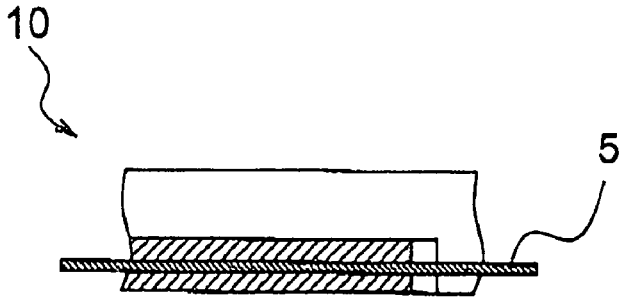
FIGS. 8A–B are diagrams comparing a narrow press-fitting groove for cantilever contact in the prior art and a press-fitting groove modified to facilitate molding according to the embodiment of the present invention.
Figure 8B:
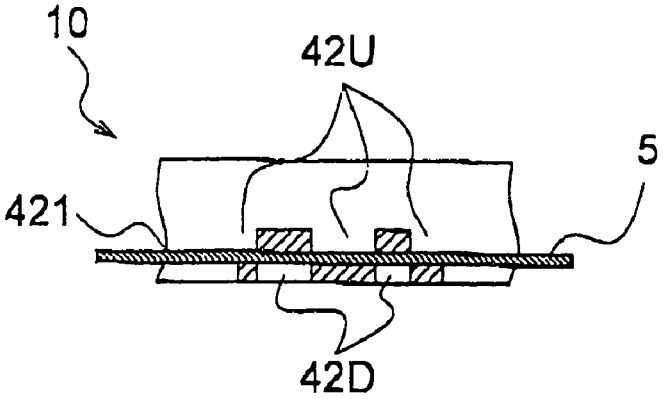
Figure 9:
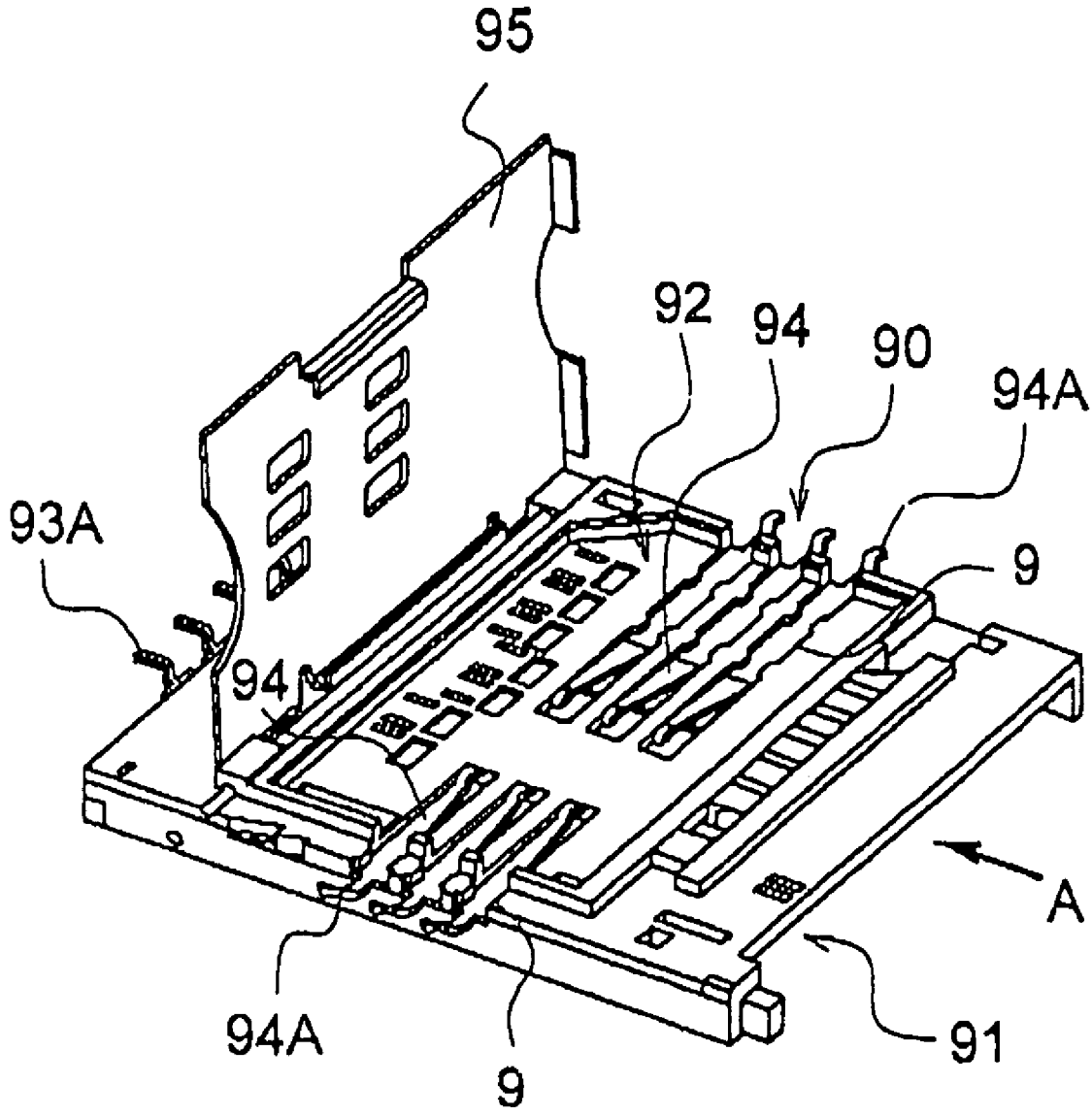
FIG. 9 is a perspective view showing a memory card connector of Japanese Published Unexamined Patent Publication No. 2002-134234 in the state in which an opening/closing cover is opened and corresponds to FIG. 1 of Japanese Published Unexamined Patent Publication No. 2002-134234.

FIGS. 8A and 8B are diagrams comparing a narrow press-fitting groove for cantilever contact of a prior art and a press-fitting groove modified to facilitate molding. FIG. 8A is a transverse sectional view of the prior-art connector 10, and FIG. 8B is a sectional view of the improved connector 10.

As shown in FIG. 8A, with the prior-art connector 10, the press-fitting hole, in which the first fixed part 5B, shown in FIG. 3, is press-fitted, is a through hole. As mentioned above, for the molding of such a narrow through hole, a narrow metal core (or so-called core) is necessary. Also as mentioned above, such a narrow metal core that is to serve as a core has insufficiency in terms of strength and durability.

Meanwhile, as shown in FIG. 8B, with the modified connector 10, the upper-face opened recess parts 42U and the lower-face opened recess parts 42D are formed in an alternating manner by the combination of the upper die 1 and the lower die 2 as shown in FIG. 6. A first press-fitting groove 421 is formed in an intermittent manner by the upper-face opened recess parts 42U and the lower-face opened recess parts 42D.

And as shown in FIG. 8B, the upper-face opened recess parts 42U and the lower-face opened recess parts 42D that are formed in each narrow press-fitting groove 421 for cantilever contact 5 are made shallow in the depth of the recess. The upper die 1 and the lower die 2, shown in FIG. 6, for molding the upper-face opened recess parts 42U and the lower-face opened recess parts 42D can thus be provided as dies of adequate strength and durability.

What is claimed is:

1. A connector comprising:

an insulating housing, in which contact cavities are formed; and at least one cantilever contact, to be press-fitted into at least one of the contact cavities;

wherein each of the contact cavities comprising a rectangular press-fitting groove, in which a fixed part of the cantilever contact is press-fitted, has upper-face opened recess parts and lower-face opened recess parts in an alternating manner such that a continuous groove space defined by the press-fitting groove comprises an upper-face open space defined by each of the upper-face opened recess parts and an lower-face open space defined by each of the lower-face opened recess parts, in an alternating manner.

2. A memory card connector, which is electrically connected to a memory card by inserting the memory card having surface contact terminals arranged at an end part, the memory card connector comprising:

a housing comprising a card holding part of an approximately thin rectangular parallelepiped shape including a housing space and a card insertion port, through which the memory card is inserted, the memory card being held in the housing space so that the surface contact terminals are located at a near position from the card insertion port; and a plurality of cantilever contacts having contact points being positioned in the card holding part, the contact points to be contacted with the surface contact terminals of the memory card, each of the cantilever contacts having a lead part, to be solder-bonded to an opposite side to the contact points, extending outside from a stopping wall opposite to the card insertion port;

wherein a plurality of first press-fitting grooves for holding first fixed parts near free ends part having the contact points, are formed in a bottom surface of the card holding part, wherein a plurality of second press-fitting grooves for holding second fixed parts near the lead parts, are formed in a bottom face of the housing that opposes to the bottom face of the card holding part, each of the first press-fitting grooves has upper-face opened recess parts and lower-face opened recess parts, which are continuous with the first press-fitting groove, formed therein in an alternating manner, and each of the first press-fitting groove is formed in an intermittent manner by the upper-face opened recess parts and lower-face opened recess parts.

3. A press-fitting groove, in which a fixed part of a cantilever contact is press-fitted, wherein:

the press-fitting groove is defined by two pairs of opposing walls, a first pair of walls extend continuously in parallel along a longitudinal direction;

a second pair of walls extend discontinuously in parallel along the longitudinal directions, the first and second pairs of walls being adjoining at edges thereof;

when the first pair of walls are disposed separately and oppositely with a predetermined distance in a lateral direction, the second pair of walls are disposed separately and oppositely with another predetermined distance in a vertical direction, the second pair of walls comprising a first wall and a second wall;

the first and second walls extend in a longitudinal direction in a discontinuous manner and do not overlap in a plan view.

4. The press-fitting groove according to claim 3, wherein the first wall has a continuous opening in a middle of a width of the first wall along the longitudinal direction.

5. A connector comprising a groove assembly including at least one press-fitting groove of claim 3, wherein the one press-fitting groove is aligned with another press-fitting groove in the groove assembly.

* * * * *